US005473983A

United States Patent [19]

Maul

[11] Patent Number: 5,473,983

[45] Date of Patent: Dec. 12, 1995

[54] ROTARY PRINTING PRESS

[75] Inventor: Bernhard Maul, Heidelberg, Germany

[73] Assignee: Heidelberger Druckmaschinen Aktiengesellschaft, Heidelberg, Germany

[21] Appl. No.: 285,505

[22] Filed: Aug. 3, 1994

[30] Foreign Application Priority Data

Aug. 5, 1993 [DE] Germany ..... 43 26 261.9

[51] Int. Cl.[6] ..... B41F 7/02; B41F 21/04

[52] U.S. Cl. ..... 101/217; 101/411

[58] Field of Search ..... 101/409–412, 101/415.1, 378, 217, 218, 136, 137, 142, 141, 232

[56] References Cited

U.S. PATENT DOCUMENTS

| | | | |
|---|---|---|---|
| 4,101,122 | 7/1978 | Jeschke | 101/410 X |
| 4,367,679 | 1/1983 | Ishii et al. . | |
| 4,700,626 | 10/1987 | Iwamoto et al. | 101/411 |
| 4,844,433 | 7/1989 | Hastie . | |
| 4,895,073 | 1/1990 | Wieland | 101/409 |
| 5,031,534 | 7/1991 | Brunner | 101/365 |

FOREIGN PATENT DOCUMENTS

| | | |
|---|---|---|
| 841756 | 6/1952 | Germany . |
| 2186552 | 8/1987 | United Kingdom . |

*Primary Examiner*—J. Reed Fisher

[57] ABSTRACT

A rotary printing press for printing on sheets of printing stock will typically have cylinders mounted therein for transporting the sheets of printing stock through the printing press. Such transfer cylinders can typically be equipped with a gripper device for engaging the sheets of printing stock, which gripper device can be formed be a plurality of individual gripping fingers pivot-mounted to the cylinder, with each gripping finger being operated directly and substantially separately from the other gripping fingers.

3 Claims, 4 Drawing Sheets

ROTARY PRINTING PRESS

BACKGROUND OF THE INVENTION

1. Field of the Invention

The present invention generally relates to a rotary printing press for printing on sheets of printing stock. Such a printing press will typically have cylinders mounted therein, such as the plate cylinder, blanket cylinder, sheet drum and sheet transfer cylinders. The sheets of printing stock therefore need to be conveyed or transferred about the cylinders from the sheet supply source to the stacking device for stacking printed sheets. In this regard, the present invention more particularly relates to a gripper device of a rotary printing press, for conveying the sheets of printing stock on the outer cylindrical surface of the cylinders of the printing press. Such a gripping device can generally have gripper fingers which can be pivot-mounted with the cylinder, and which can cooperate with a gripper pad disposed on the cylinder. These gripper fingers can typically be controlled according to the sheet sequence of the printing run being performed.

2. Background Information

Such gripper devices are generally used to convey individual sheets of printing stock, or sheet layers, and therefore, need to be controlled according to the sheet sequence, with the control periods being timed so as to be substantially very short. Conventional gripper devices are typically equipped with relatively long grippers mounted on gripper shafts. The gripper shafts are, in turn, moved by control cams via cam rolls. The mass of the grippers, in combination with their holding devices and the gripper shaft, generally permits only a certain maximum machine speed before the cam roll would essentially permanently move away from the control cam, and thereby no longer grip sheets to be transferred. Due to the long lever arm of the grippers and the required holding forces for gripping a sheet of printing stock, grippers and holding devices generally need to be of stable design and thus tend to be heavy, which also has a limiting effect on the machine speed. Furthermore, since springs are generally used to hold the control cams in contact with the cam rolls, it has been determined that it is essentially not possible to increase the spring forces to an unlimited extent in order to press the cam roll into contact with the control cam, which contact will therefore decrease as a result of the wear and tear of the camming components.

OBJECT OF THE INVENTION

Proceeding from the above-mentioned disadvantages, it is the object of the present invention to design a gripper device which is suitable for high machine speeds, and is essentially very easy and inexpensive to manufacture.

SUMMARY OF THE INVENTION

According to the present invention, this object can be achieved by preferably mounting each individual gripper of a gripper row, on a respective bolt provided parallel to the cylinder axis in the area of the outer cylindrical surface of a sheet-guiding cylinder. In addition, each gripper can also preferably be provided with a toothed segment that interacts with toothed segment bodies of a drive shaft. Further, the drive shaft can preferably be mounted parallel to the gripper row and extending over the length of the sheet-guiding cylinder, and in the area of the grippers, the drive shaft can preferably have toothed-segment bodies, the toothing of which meshes with the toothing of the toothed segments of the grippers. The drive shaft can also preferably be controlled by a pivot drive. With at least one embodiment of the present invention, the lever arm of the gripper finger may be reduced to a minimum so that the holding force required may be applied by means of a relatively small lever arm. As a result thereof, the mass of the gripper device can be reduced, thus permitting a higher machine speed.

In an advantageous embodiment of the gripper device in accordance with present invention, the reduction ratio between toothed-segment body and tooth segment of the gripper can preferably be approximately 3:1. Such a reduction ratio can essentially make it possible, for example, in the case of a control cam, to keep the stroke of the cam roll relatively small.

Another advantageous embodiment of the gripper device in accordance with the present invention is characterized in that the gripper fingers preferably feature a radius of only approximately 12 mm with respect to the supporting surface of the gripper area, and that the gripper area is preferably designed so as to be spherical in longitudinal direction of the gripper finger. Due to the small dimension of the grippers, the bolt for mounting a respective gripper may have a diameter of approximately 8 mm, for example. In this case a separate bolt may be used for each gripper, with the bolts being pivot-mounted on the cylinder by means of known bearing bodies.

The fact that the inventive grippers require only little space on the cylinder circumference is also advantageous. It has also been determined that grippers of such design in accordance with the present invention may be produced in large quantities and thus at low cost. It may also be conceivable to use, instead of a pivot drive in combination with a drive shaft, individual drives for the grippers, which individual drives could, for example, be controlled pneumatically. Such an arrangement could preferably prevent the occurrence of any reactive effects, caused by the gripper control, on the machine drive.

In a further advantageous embodiment of the present invention the center of the mounting bolts for the grippers can preferably be approximately 3.5 mm below the surface of the gripper pad. Since, due to the small dimension, the grippers may be mounted in a position very far out in the outer area of the outer cylindrical surface, the center of rotation of each gripper is essentially favorably located so that during the closing of the grippers a displacing movement can be excluded to a large extent.

In summary, one aspect of the invention resides broadly in a a printing press comprising: a frame; a plate cylinder rotatably mounted on the frame, the plate cylinder for positioning a printing plate thereon; an ink reservoir for holding a supply of ink; an inking mechanism for transferring the ink between the ink reservoir and the plate cylinder at least during operation of the printing press; the inking mechanism comprising a plurality of inking rollers, a plurality of individually adjustable ink zone metering devices disposed in conjunction with the ink reservoir, at least one ink fountain roller positioned adjacent the plurality of individually adjustable ink zone metering devices to receive ink via the metering devices, and at least one ink transfer roller for transferring ink between the ink fountain roller and at least one of the plurality of inking rollers; sheet feeding apparatus for feeding sheets of printing stock into the printing press; a rubber blanket cylinder having a rubber blanket disposed thereabout for receiving an ink impression from the plate cylinder; at least one sheet transfer cylinder for receiving sheets being fed and transferring sheets through the printing press; the at least one sheet transfer cylinder comprising: a plurality of individual gripper elements disposed along the length of the at least one sheet transfer cylinder, each of the individual gripper elements comprising apparatus for engaging an edge of a sheet being transferred to move the engaged sheet upon rotation of the at least one sheet transfer cylinder; apparatus for directly and individually driving at least one of the gripper elements substantially separately from others of the gripper elements to engage and disengage each the apparatus for engaging with a sheet being transferred; the drive apparatus comprising a plurality of individual drive apparatus extending from the drive apparatus to each the at least one gripper element; and each of the plurality of individual drive apparatus driving at least one of the gripper elements.

Another aspect of the invention resides broadly in a sheet transfer cylinder for conveying sheets of printing stock for a rotary printing machine, the sheet transfer cylinder comprising: a plurality of gripper apparatus disposed along the length of the at least one sheet transfer cylinder, each of the gripper apparatus comprising apparatus for engaging an edge of a sheet being conveyed to move the engaged sheet upon rotation of the sheet transfer cylinder; apparatus for pivotably mounting each of the plurality of gripper apparatus to the cylinder for pivoting of the gripper apparatus and pivoting of the apparatus for engaging into and out of engagement with sheets being transferred; drive shaft apparatus for driving each the gripper apparatus to pivot each the gripper apparatus and engage and disengage each the apparatus for engaging with sheets being transferred; the apparatus for mounting and the drive shaft apparatus being configured to minimize at least one torsional physical parameter at the gripper apparatus during operation of the gripper apparatus.

One addition aspect of the invention resides broadly in a sheet transfer cylinder for conveying sheets of printing stock for a rotary printing press, the sheet transfer cylinder comprising: a plurality of gripper apparatus disposed along the length of the at least one sheet transfer cylinder, each of the gripper apparatus comprising apparatus for engaging an edge of a sheet being conveyed to move the engaged sheet upon rotation of the sheet transfer cylinder; apparatus for individually pivotably mounting each of the plurality of gripper apparatus to the cylinder separately from others of the gripper apparatus for pivotable movement of each of the gripper apparatus independently from pivotable movement of others of the gripper apparatus; drive apparatus for driving each the gripper apparatus to pivot each gripper apparatus and engage and disengage each the apparatus for engaging with sheets being transferred; and the drive apparatus comprising apparatus extending from the drive apparatus to each of the plurality of gripper apparatus to pivot each gripper apparatus separately from others of the gripper apparatus upon movement of the drive apparatus.

BRIEF DESCRIPTION OF THE DRAWINGS

Specimen embodiments of the present invention are schematically illustrated in the accompanying drawings, in which.

DESCRIPTION OF THE PREFERRED EMBODIMENTS

Figure 1:
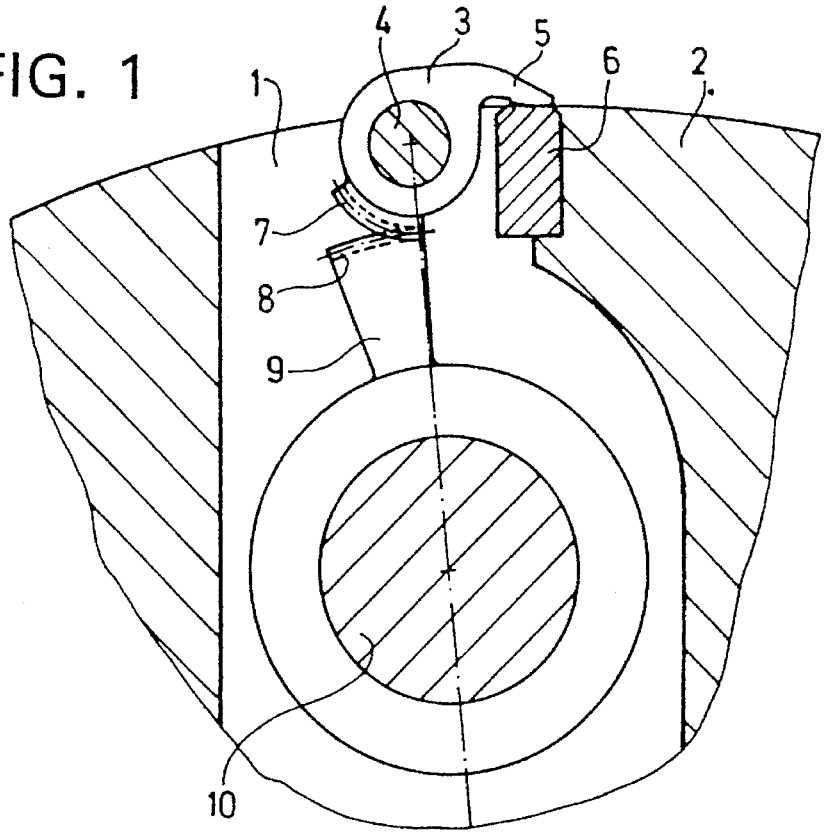
FIG. 1 a partial cross-section through a gripper device.
Figure 1A:
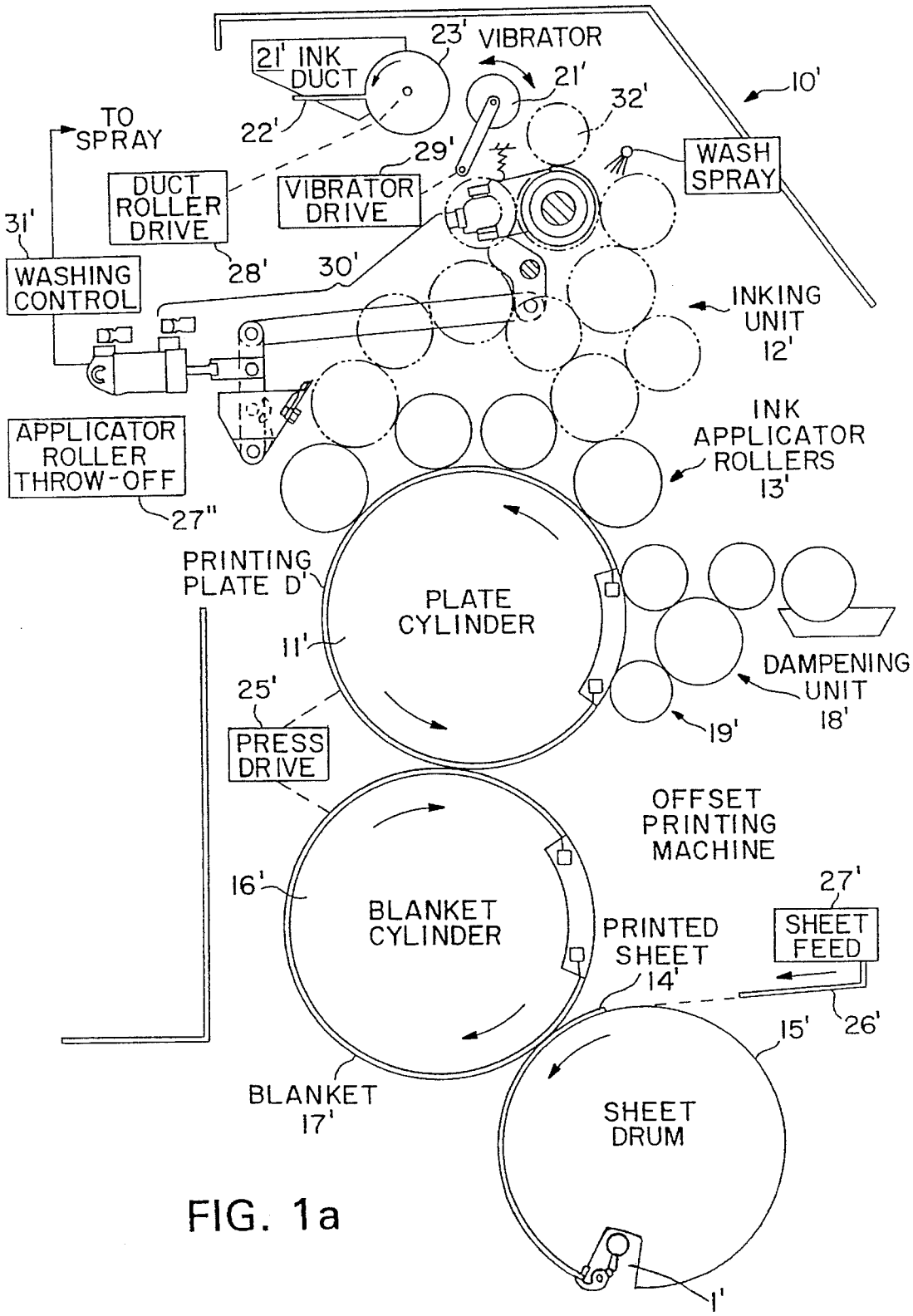
FIG. 1*a* shows a typical rotary printing press having a gripper device for transport of sheets of printing stock.

FIG. 1*a* illustrates a rotary print stand 10' of a rotary printing press which can employ a gripper device 1' in accordance with at least one embodiment of the present invention. Rotary print stand 10' generally includes: a plate cylinder 11' for having mounted thereon a printing plate D'; an inking unit 12' which includes ink applicator rollers 13' for applying ink to the printing plate; a dampening (or wetting) unit 18' having dampening applicator rollers 19' for transferring a dampening agent to the printing plate, a blanket cylinder 16' carrying a rubber blanket 17' for receiving an ink impression from the printing plate, and a sheet drum 15' for carrying a printed sheet 14' onto which the ink impression carried by blanket 17' is transferred. A duct roller 23' can typically be mounted adjacent to ink duct 21'. Typically, ink is transferred from duct roller 23' to inking unit 12' by means of a vibrator roller 21' which oscillates to successively pick up ink from duct roller 23' and deposit the same on a roller 32' of inking unit 10'. Typically, the printing stand 10' will also include auxiliary mechanisms such as, for example, a duct roller drive 28', a vibrator roller drive 29', an applicator roller throw-off 27" for lifting the ink applicator rollers 13' off of the printing plate, a press drive 25', a sheet feed 27' for supplying the sheets to be printed 26' to sheet drum 15', and some sort of cleaning or washing arrangement generally indicated as 30' and 31'.

Figure 2:
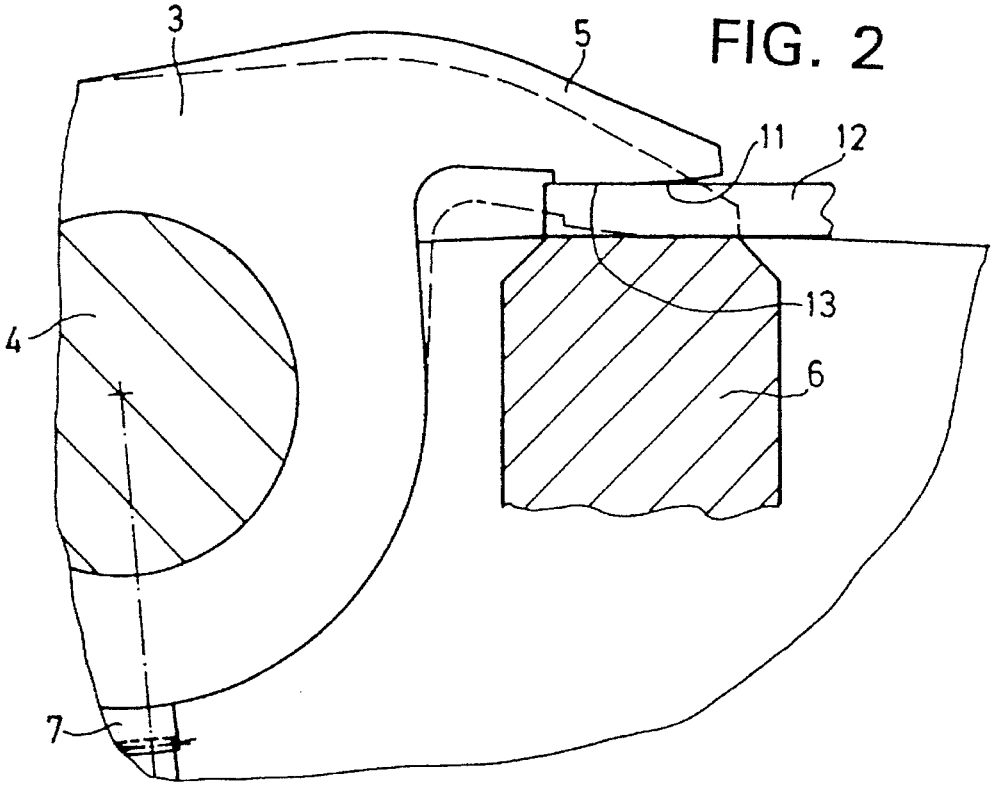
FIG. 2 shows an enlarged view of a gripper device.

FIG. 1*a* also additionally illustrates a gripper device 1', shown in greater detail in FIGS. 1 and 2, disposed on the sheet drum 15' for grasping a sheet of printing stock 14' and transporting the sheet of printing stock 14' at least through contact with the blanket cylinder 16' to transfer the ink profile from the blanket 17' to the sheet 14'. Any additional rollers for transferring the printed sheet 14' from the sheet drum 15' to a further inking unit 10', or a sheet stacking device (not shown) could also be provided with such gripper devices 1'.

It should be understood that the components discussed above with relation to FIG. 1*a* may, if appropriate, essentially be considered to be interchangeable with similar components discussed further herebelow with relation to FIGS. 1 and 2.

Figure 1B:
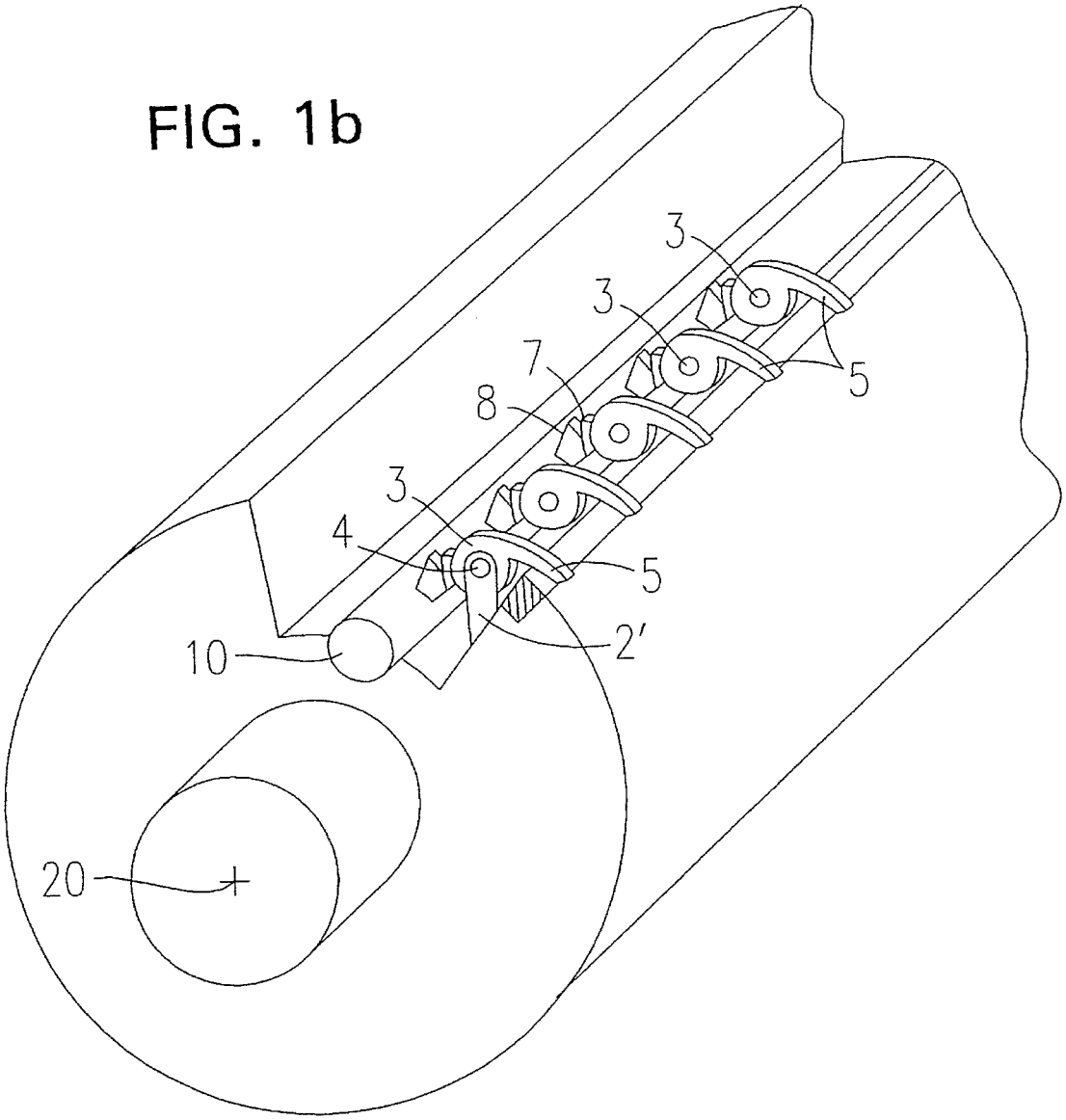
FIG. 1*b* shows a cylinder having a plurality of gripper devices.

As shown in FIG. 1*b*, a plurality of grippers 3 can preferably be arranged side by side in an axially-provided groove 1 of a sheet-guiding cylinder 2 of a printing press. FIGS. 1 and 2 show the grippers 3 and the operational components associated therewith in greater detail. It should be understood that the number of grippers 3 and the location and positioning of the grippers 3 would be well within the skill of the artisan.

It should be understood that the sheet-guiding cylinder 2 could preferably correspond to sheet drum 15' of FIG. 1*a*.

The grippers 3 can preferably be separately fastened to respective bolts 4 which, in turn, can be attached to cylinder portions 2' within the groove 1 of the cylinder 2 by means of appropriate bearings (not shown). A gripper finger 5 extending from the grippers 3 can be configured to cooperate with a gripper pad 6. This gripper pad 6 can preferably be fastened to the cylinder 2. Each gripper 3 can preferably be provided with a toothed segment 7 that is configured to mesh with toothing 8 of a toothed-segment body 9. The toothed-segment bodies 9 can be secured on a drive shaft 10 which, in turn, can be rotatably mounted in the front ends of the cylinder 2 by appropriate bearing devices (not shown). Operation of the grippers 3 can then be provided via movement of the drive shaft 10 which essentially rocks the toothed-segment bodies 9 in a back-and-forth, or reciprocating motion. Via the intermeshed toothed portions 7 and 8, the gripper 3 can thereby also be rocked, or pivoted on the bolts 4 to raise and lower the gripper fingers 5 relative to the gripper pad 6. Thus, each of the grippers 3 can be driven directly by the drive shaft 10, while in essence being driven separately from others of the grippers 3.

The reduction ratio between the toothed-segment body 9 and tooth segment 7 of the gripper can preferably be approximately 3:1. In other words, a revolution of about 15° by the drive shaft 10 can preferably produce a revolution of about 45° of the gripper 3, and thus, a relatively short rotation of the drive shaft 10 can preferably produce a greater amount of rotation in the gripper 3, so that the stroke of the drive for the drive shaft can be kept relatively small, while still enabling at least about a 45° movement of the gripper fingers 5. In alternative embodiments of the present invention, other reduction ratios could be provided, which could possibly range from about 2:1 for some applications to possibly about 4:1, or even 5:1 for other applications. The reduction ratio of the toothing could also be space-related, and larger spaces could allow for larger reduction ratios as larger diameter drive shafts 10 could be used.

To control the drive shaft 10, there may be provided a pivot drive, e.g. in the form of a cam disk in combination with a cam roll and a roller lever, with the roller lever being fastened to the drive shaft 10. The cam disk thus transmits a pivoting movement onto the drive shaft 10 which, via the toothing 8, is then communicated onto the toothed segment 7 and the gripper 3, thus opening and closing the gripper respectively. The gripper may preferably be opened up, or rotated about 45°, but other opening angles could also be possible, and could essentially include any angle which allowed a wide enough opening for a sheet of printing stock to be inserted under the gripper finger 5, i.e., possibly as small as about 10°, and up to about 90°, or even greater depending on the space available and the desired function. Pivot drives, as such, are generally known and therefore are not described nor shown in any great detail herein.

Figure 3:
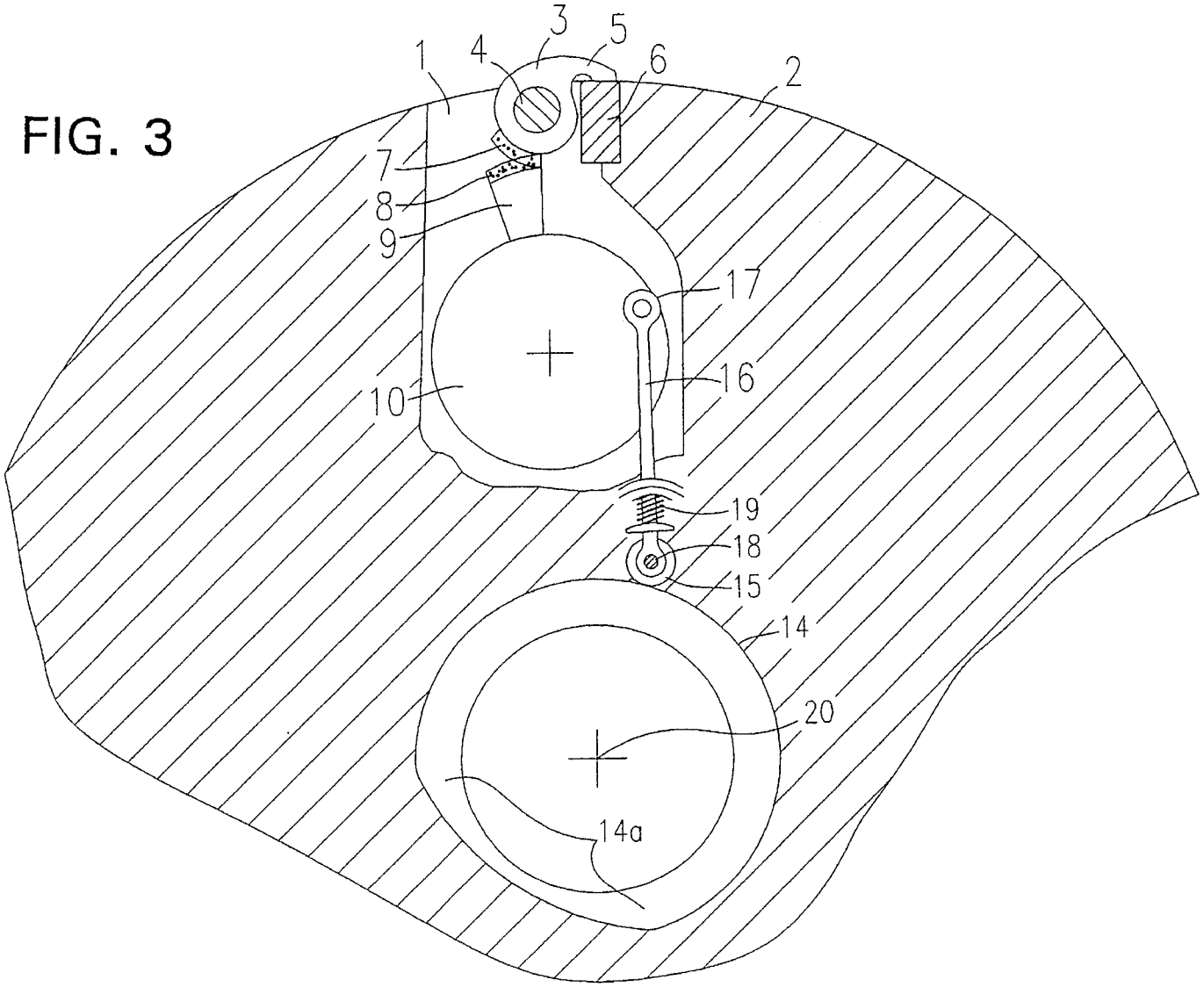
FIG. 3 shows a simplified type of camming arrangement which could be used for pivoting the gripper devices.

A simplified view of one type of camming device, which could essentially be utilized in accordance with the present invention is depicted in FIG. 3. This representation is essentially simplified, and is essentially meant to generally depict what could be considered to be main components of a camming device. To control the drive shaft 10, the cylinder 2 could be provided with a camming surface 14 disposed about the longitudinal axis 20, which axis defines the rotational axis of the cylinder 2. The drive shaft 10 could then be provided with a cam lever 16 which can be connected to the drive shaft 10 by a swivel bearing 17. The other end of the cam lever 16 could be provided with a cam roller, or follower 15, which can be rotatably mounted to the lever 16 via an additional bearing 18. A resilient member could also be provided about the lever 16 to press the roller 15 into contact with the cam surface 14.

Thus, as the cylinder 2 rotates about axis 20, the cam roller 15 will follow the contour of the cam surface 14. In the region **14*a* of the cam surface 14, the lever 16 will drop downwardly, thereby rotating the body segment 9 to the right to lift the gripper finger 5 away from the gripper pad 6. A further rotation of the cylinder 2 will again raise the lever 16 to thereby push the body segment 9 back towards the left to lower the gripper finger 5 back towards the gripper pad 6** to grip a sheet of printing stock therebetween.

In addition to the above described components, additional known camming arrangements, could also be provided. Other type of camming arrangement which could possibly be used in conjunction with the gripper device of the present invention are described in the following U.S. Patent: U.S. Pat. No. 5,076,165 to Gerhard Pollich, entitled "Swinging Gripper Arrangement for Sheet-Processing Machines, in Particular, Sheet-Fed Offset Printing Presses"; and U.S. Pat. No. 4,311,093 to Abendroth et al., entitled "Sheet Feeding Assembly Including Provision for Coordinated Action of Pre-Gripper and Front Stop".

Additionally, other types of suitable reciprocating mechanisms, which are well known to those of ordinary skill in the art, could also possibly be used for opening and closing the gripper finger 5, such as an oscillating crank.

As shown in FIG. 2, a sheet 12 can be pressed by the gripper area 11 of the gripper finger 5 onto the gripper pad 6 where the sheet 12 will then be held. In at least one embodiment of the present invention, the gripper pad 6 can preferably be made out of a material having a high friction coefficient to thereby increase the grasping ability of the gripper arm 5. Such a material could possibly be a rubber material, for example.

In order to compensate for different sheet thicknesses the gripper area 11 of the gripper finger 5 can preferably be designed so as to be generally spherical in the longitudinal direction of the finger 5. Thus, an exact supporting surface 13 can essentially always be ensured. In other possible embodiments, alternative curved surface configurations, such as for example, possibly a logarithmic curve, could also preferably be provided for the surface 13, and the curvature of the surface 13 could be configured in relation to the center of rotation of the gripper 3 with respect to the surface of the gripper pad 6. In FIG. 2, a broken line indicates that the spherical design of the gripper area is such that an essentially exact supporting surface 13 is ensured even given an extremely thin sheet material. In this case, the supporting surface 13 has a mean radius of curvature of approximately 12 mm with respect to the center of rotation of the gripper 3. Also, the center of rotation of the gripper 3, in the depicted embodiment is preferably disposed about 3.5 mm below the surface of the gripper pad 6.

In the depicted embodiment, wherein the bolts 4 preferably have a diameter of about 8 mm, the gripper 3 can preferably have a diameter of about 14 mm. The gripper finger 5 can preferably extend about 7 to about 9 mm beyond the circumference of the gripper 3. The toothed portion 7 of the gripper 3 could possibly have a mean diameter of about 17 mm, thereby providing a circumference of about 53.5 mm. Also, the diameter of the drive shaft 10 could preferably be about 39.5 mm, with the mean diameter of the toothing of the toothed segment bodies 9 being about 52.5 mm. Thus, the circumference at the toothing 9 would be about 165 mm, which is about 3 times the circumference of the toothed portion 7 to provide the reduction ration of 3:1.

In alternative possible configurations of the present invention, a cylinder 2 could possibly be provided with 2 such grippers 3 disposed at about 180° with respect to one another. For such a configuration, the camming surface 14 could have two surface portions **14*a* disposed diametrically opposite to one another at about 180°. Alternatively, a cylinder 2 might also have three such grippers 3 disposed at 120° with respect to one another, and thereby require a camming surface 14 with three surface portions 14*a***.

For gripper elements, because of the rapid repetition in the shifting in the direction of movement of the gripper elements, a resonance can develop in an elongated shaft connecting the gripper elements, when the drive of the shaft occurs only at one end thereof. In other words, if the drive initiates a movement at the first end of the shaft, because of the mass of the shaft, and the inertia which develops with the moving mass, there can be an inherent lag in the movement of the second end, or, in effect, a twisting could occur, depending on the torsional rigidity of the shaft. Then, when the direction of movement is reversed at the first end, there would be a lag in the reversal at the second end, and so on, each time a reversal in direction of movement occurs. Thus, there arises the possibility that a resonance could develop in the shaft, and, in effect, the grippers at the drive end of the shaft could be closing just slightly ahead of the grippers at the trailing end of the shaft, and similarly during release, could be opening slightly ahead of the grippers at the trailing end. Because of the possibility of developing such a leading/trailing effect, paper transfer could be effected, and jamming might even occur at higher operational speeds.

At least one embodiment of the present invention overcomes this resonance problem by mounting the gripper elements on several smaller shafts, or even individually mounting each gripper elements on separate bolts, thereby reducing the mass of the grippers which needs to be rotated, and reducing the overall inertia at the moving grippers. Further, a larger diameter drive shaft 10 can then preferably be provided to increase the torsional rigidity of the drive shaft 10. Alternatively, a stiffer material could be used for the drive shaft 10 to increase the torsional rigidity. The drive shaft 10 can preferably directly and individually drive at least one set of gripper elements separately from other gripper elements, wherein each individual gripper element can preferably be driven separately and individually from the others. By increasing at least one of the physical parameters of this larger shaft 10, such as the diameter, or the resilience of the material of the shaft, etc., the shaft 10, in accordance with at least one embodiment of the present invention can preferably be configured to have greater torsional rigidity, to minimize torsional resonance during operation. In other words, the torsional resonance is preferably maintained at a frequency which is less than the frequency of the reciprocation of the drive drive shaft.

Some of the torsional parameters which could essentially be improved in at least one embodiment of the present invention include the following: torsional resonance, resonance, torsional inertia, inertia, torsional lag, lag between movement of gripper elements upon actuation thereof, etc.

Some of the many advantages provided by the gripping arrangements in accordance with the present invention could possibly include: a more stable drive shaft 10 with less twisting torque due to a larger diameter thereof; a mass reduction which could result from individually mounting each gripper 3 with a bolt 4 rather than a common bar disposed along the length of the cylinder; a reduction in the amount of energy required to pivot the grippers 3 due to the diameter ratio of the toothing of the toothed-segment 9 to the toothed segment 7; a reduction in the mass of the grippers 3 due to their peripheral mounting and short finger length; and higher machine speeds due to the reduction in mass and the higher reduction ratio of the toothing, wherein the camming members, by driving the shaft 10 can move at a slower speed than if the camming members were driving the grippers 3, as the angular velocity of the periphery at the toothed segment 7 can be approximately triple the angular velocity of the teeth of the toothed member 9 due to the reduction ratio.

One feature of the invention resides broadly in the gripper device for a rotary printing machine for conveying sheets on an outer cylindrical surface of a cylinder, with gripper fingers being pivot-mounted and cooperating with a gripper pad, said grippers being controlled according to the sheet sequence, characterized in that each individual gripper 3 of a gripper row is mounted on a bolt 4, provided parallel to the cylinder axis, in the area of an outer cylindrical surface of a sheet-guiding cylinder 2, that each of said grippers 3 features a toothed segment 7, that a drive shaft 10 extending over the length of said sheet-guiding cylinder 2 and being controllable by a pivot drive is provided parallel to said gripper row, and that, in the area of said grippers 3, said drive shaft 10 comprises toothed-segment bodies 9 the toothing of which meshes with the toothing of said toothed segments 7 of said grippers 3.

Another feature of the invention resides broadly in the gripper device characterized in that there is provided a reduction ration of approximately 3:1 between toothed-segment bodies 9 and toothed segments 7 of said grippers 3.

Yet another feature of the invention resides broadly in the gripper device characterized in that gripper finger 5 feature a mean radius of approximately 12 mm with respect to a supporting surface 13 of a gripper area 11, and that said gripper area 11 is designed so as to be spherical in longitudinal direction of said gripper finger 5.

Still another feature of the invention resides broadly in the gripper device characterized in that the center of said bolt 4 is approximately 3.5 mm below a gripper pad 6.

Some examples of sheet-feeding assemblies, which may have parts which are analogous to those usable in the printing press of an embodiment of the present invention can be found in the following U.S. Patents: U.S. Pat. No. 5,287,809 to Greive, entitles "Method and Device for Feeding, Aligning and Holding a Sheet on a Sheet-Processing Machine"; U.S. Pat. No. 5,255,605 to Pfisterer, entitled "Sheet-Gripper Device for Sheet-Fed Rotary Printing Presses"; and U.S. Pat. No. 4,120,244 entitled "Gripper Movement Changeover Device On a Sheet-Turning Drum for Perfector Printing Machines"; and U.S. Pat. No. 4,475,459 entitled "Impression Cylinder for Sheet-Fed Rotogravure Presses".

Some additional examples of sheet feeding gripper elements and arrangements which can be used to reciprocate the gripper elements, which may be usable in conjunction with the present invention, are disclosed by the following U.S. Patents: U.S. Pat. No. 4,290,595 to Thünker, entitled "Rotatable Advance or Forward Gripper Drum" which describes a linkage transmission for reciprocating the gripper 3; U.S. Pat. No. 4,357,870 to Rudolph et al. entitled "Driving Mechanism for Groups of Adjustable Sheet-Gripping Elements in A Transfer Cylinder of A Sheet-Fed Printing Machine", which also shows a linkage transmission; U.S. Pat. No. 4,583,728 to Mathes, entitled "Auxiliary Gripper Drive", which shows an alternative camming arrangement; and U.S. Pat. No. 4,854,236 to Thünker et al. entitled "Transmission System for Forming Cyclical Motion From Rotational Motion Printing Press with Counterbalance for Torque Fluctuation of Gripper Feed Drum", which shows a further camming arrangement.

The appended drawings in their entirety, including all dimensions, proportions and/or shapes in at least one embodiment of the invention, are accurate and to scale and are hereby included by reference into this specification.

All, or substantially all, of the components and methods of the various embodiments may be used with at least one embodiment or all of the embodiments, if more than one embodiment is described herein.

All of the patents, patent applications and publications recited herein, and in the Declaration attached hereto, are hereby incorporated by reference as if set forth in their entirety herein.

The corresponding foreign patent publication applications, namely, Federal Republic of Germany Patent Application No. P 43 26 261.9, filed on Aug. 5, 1993, having inventor Bernhard Maul, and DE-OS P 43 26 261.9 and DE-PS P 43 26 261.9, as well as their published equivalents, and other equivalents or corresponding applications, if any, in corresponding cases in the Federal Republic of Germany and elsewhere, and the references cited in any of the documents cited herein, are hereby incorporated by reference as if set forth in their entirety herein.

The details in the patents, patent applications and publications may be considered to be incorporable, at applicant's option, into the claims during prosecution as further limitations in the claims to patentably distinguish any amended claims from any applied prior art.

The invention as described hereinabove in the context of the preferred embodiments is not to be taken as limited to all of the provided details thereof, since modifications and variations thereof may be made without departing from the spirit and scope of the invention.

What is claimed is:

1. A printing press comprising:

a frame;

a plate cylinder rotatably mounted on said frame, said plate cylinder for positioning a printing plate thereon;

an ink reservoir for holding a supply of ink;

an inking mechanism for transferring the ink between said ink reservoir and said plate cylinder at least during operation of said printing press;

said inking mechanism comprising a plurality of inking rollers, a plurality of individually adjustable ink zone metering devices disposed in conjunction with the ink reservoir, at least one ink fountain roller positioned adjacent said plurality of individually adjustable ink zone metering devices to receive ink via said metering devices, and at least one ink transfer roller for transferring ink between said ink fountain roller and at least one of said plurality of inking rollers;

sheet feeding means for feeding sheets of printing stock into the printing press;

a rubber blanket cylinder having a rubber blanket disposed thereabout for receiving an ink impression from the plate cylinder;

at least one sheet transfer cylinder for receiving sheets being fed and for transferring sheets through the printing press, said at least one sheet transfer cylinder having an outer peripheral surface, and the outer peripheral surface contacts sheets being transferred over a substantial portion of the sheet being transferred;

said at least one sheet transfer cylinder comprising:

a plurality of individual gripper elements disposed along the length of said at least one sheet transfer cylinder, each of said individual gripper elements comprising means for engaging an edge of a sheet being transferred to move the engaged sheet upon rotation of said at least one sheet transfer cylinder;

means for driving said gripper elements to engage and disengage each said means for engaging with a sheet being transferred;

said drive means comprising a plurality of individual drive means for directly and individually driving at least one corresponding one of said gripper elements substantially separately from others of said gripper elements, each of said individual drive means extending from said drive means to at least one corresponding one of said at least one gripper element, each of said plurality of individual drive means driving at least one of said gripper elements;

means for moving said drive means between first and second positions of said drive means to move corresponding ones of said gripper elements between first and second positions of said gripper elements to engage and disengage said means for engaging with a sheet being transferred;

each of said individual drive means comprising means for moving each of their corresponding gripper elements a first distance upon movement of said drive means a second distance, said first distance being substantially greater than said second distance;

said at least one sheet transfer cylinder has a longitudinal dimension, and said at least one sheet transfer cylinder comprises a recess disposed along the longitudinal dimension thereof;

said drive means comprises drive shaft means rotatably mounted within the longitudinal recess along the longitudinal dimension of said at least one sheet transfer cylinder;

said means for moving said drive means comprises means for rotating said drive shaft means between first and second rotational positions;

said first distance comprises a first rotational angle, and said second distance comprises a second rotational angle;

each of said plurality of individual drive means comprising means for rotating said gripper elements through said first rotational angle upon rotation of said drive means through said second rotational angle, said first rotational angle being substantially greater than said second rotational angle;

each of said plurality of gripper elements comprises a peripheral surface having teeth disposed thereon;

said drive shaft means having a substantially cylindrical exterior surface;

each of said plurality of individual drive means comprising projections extending radially from said exterior surface of said drive shaft means;

each of said projections having an end disposed away from said drive shaft means, each said end comprising teeth for engaging said teeth of said gripper elements;

said means for moving said drive shaft means comprise means for rotating said ends of said projections of said drive shaft means through said second rotational angle to rotate said teeth of each of said plurality of individual drive means to rotate said teeth of each of said gripper elements and pivot said gripper elements through said first rotational angle;

said drive shaft means has a first diameter;

said ends of said projections forming said individual drive means have a second diameter, said second diameter being substantially greater than said first diameter;

said first rotational angle and said second rotational angle define a ratio of about 3:1;

said projections comprise wedge-shaped projections having first and second sides, said first and second sides being disposed at about 15° with respect to one another, and said wedge shaped projections comprising about 15°, in a circumferential direction, of the outer circumferential surface of said drive shaft means;

said at least one sheet transfer cylinder comprises a peripheral surface;

said longitudinal recess comprises a longitudinal groove in said at least one sheet transfer cylinder;

said longitudinal groove comprises a peripheral area adjacent the peripheral surface of said at least one sheet transfer cylinder, and an area disposed radially inwardly from said peripheral area, said area disposed radially inwardly has a width, said width being greater than said first diameter and less than said second diameter;

each of said plurality of gripper elements is pivotably mounted in said peripheral area of said longitudinal groove, and said drive means is rotatably mounted in said area radially inwardly of said peripheral area;

each said gripper element is individually mounted in said groove by bolt means;

said means for engaging of each said gripper elements comprises finger means extending from said gripper element;

said finger means being pivotable towards and away from said peripheral surface of said at least one sheet transfer cylinder, between a first position and a second position of said gripper elements, to clamp a sheet of printing stock therebetween;

each said finger means comprises a contact surface for contacting a sheet of printing stock;

said contact surface having a longitudinal dimension;

said contact surface being curved in the longitudinal dimension thereof;

said contact surface has a radius of curvature of about 12 mm;

said bolt means having a central longitudinal axis, and said central longitudinal axis of each said bolt means being disposed at about 3.5 mm radially inward of the peripheral surface of said at least one sheet transfer cylinder;

said bolt means have a diameter of about 8 mm;

said gripper elements have a diameter of about 14 mm;

said finger means extend from said gripper elements about 8 mm;

said outer peripheral surface of said at least one sheet transfer cylinder comprising an edge disposed adjacent said groove, and said at least one sheet transfer cylinder comprising a pad disposed at said edge;

said pad comprising a friction pad;

said finger means being configured for clamping a sheet of printing stock between said contact surface thereof and said pad of said peripheral surface;

said at least one sheet transfer cylinder has an axis of rotation;

said means for rotating said drive shaft means comprises:

cam means, said cam means having a cam surface disposed about the axis of rotation of said at least one sheet transfer cylinder;

cam follower means for engaging said cam surface;

means connecting said drive shaft to said cam follower; and said cam surface, said cam follower means, and said connecting means being configured to reciprocally rotate said drive shaft means between said first and second positions of said drive shaft means upon rotation of said at least one sheet transfer cylinder;

said first and second positions of said drive shaft means being disposed at about 15° angle with respect to one another; and said first and second positions of said finger means being disposed at about 45° with respect to one another.

2. A sheet transfer cylinder for conveying sheets of printing stock for a rotary printing machine, said sheet transfer cylinder comprising:

an outer peripheral surface, the sheets being transferred for being in contact with the outer peripheral surface over at least a substantial portion of the sheet;

a plurality of gripper means disposed along the length of said sheet transfer cylinder adjacent the outer peripheral surface of the sheet transfer cylinder, each of said gripper means comprising means for engaging an edge of a sheet being conveyed to clamp the sheet being conveyed between said means for engaging and the peripheral surface of said sheet transfer cylinder to move the engaged sheet upon rotation of said sheet transfer cylinder;

means for pivotably mounting each of said plurality of gripper means to said cylinder for pivoting of said gripper means and pivoting of said means for engaging into and out of engagement with sheets being transferred;

drive shaft means for driving each said gripper means to pivot each said gripper means and engage and disengage each said means for engaging with sheets being transferred;

said drive shaft means comprising means for rotationally pivoting each said gripper means through a first rotational angle upon rotation of said drive shaft means through a second rotational angle, and said first rotational angle being substantially greater than said second rotational angle;

said gripper means are pivotable through said first rotational angle solely between a first position, with said means for engaging disposed adjacent the peripheral surface, and a second position, with said means for engaging pivoted away from the peripheral surface;

said first and second positions are disposed up to an angle of about 45° with respect to one another;

each said gripper means is individually pivotably mounted to said cylinder for independent movement from the others of said gripper means;

said drive shaft means is rotatable through said second rotational angle between a third position of said drive shaft means and a fourth position of said drive shaft means;

said drive shaft means comprising a plurality of individual drive means extending from said drive shaft means to individual ones of said gripper means;

said plurality of individual drive means comprising said means for rotationally pivoting said gripper means;

each of said plurality of individual drive means pivoting one of said plurality of gripper means through said first rotational angle upon movement of said drive shaft means through said second rotational angle, said first rotational angle being about three times greater than said second rotational angle, said first rotational angle comprising said angle of up to about 45° and said second rotational angle comprising an angle of up to about 15°;

said sheet transfer cylinder has a longitudinal dimension, and said sheet transfer cylinder comprises a recess disposed along the longitudinal dimension;

each of said plurality of gripper means comprises a toothed portion extending therefrom;

said drive shaft means is disposed within the longitudinal recess;

said drive shaft means has a first portion having a first diameter, and a periphery;

each of said plurality of individual drive means comprising a projection extending radially away from said first portion of said drive shaft means towards said gripper means, each said projection extending a substantial distance from said first portion, and each said projection comprising a substantially wedge shaped projection comprising about 15°, in a circumferential direction, of the periphery of said drive shaft means;

each of said projections having an end disposed towards said gripper means, and each end comprising a toothed portion for engaging said toothed portions of each of said gripper means for movement of each of said gripper means along with movement of said drive shaft means;

said toothed portion of said individual drive means define a second diameter, and said toothed portion of said plurality of gripper means define a third diameter, said second diameter being about three times greater than said third diameter to define a reduction ratio of about 3:1;

said longitudinal recess comprises a longitudinal groove in said sheet transfer cylinder;

said longitudinal groove comprises a peripheral area adjacent the peripheral surface of said sheet transfer cylinder;

each of said plurality of gripper means is pivotably mounted in said peripheral area of said longitudinal groove;

said outer peripheral surface of said sheet transfer cylinder comprises an edge disposed adjacent said groove, said edge comprising a friction pad;

said means for engaging of each said gripper means comprises finger means extending from said gripping means;

said finger means being pivotable towards and away from said friction pad of said peripheral surface of said sheet transfer cylinder, between said first position and said second position, to clamp a sheet of printing stock therebetween;

each said finger means comprises a contact surface for contacting a sheet of printing stock;

said contact surface having a longitudinal dimension;

said contact surface being curved in the longitudinal dimension thereof;

said contact surface has a radius of curvature of about 12 mm;

said means for mounting comprises bolt means, and each said gripper means is individually mounted in said groove by a corresponding individual bolt means;

said bolt means having a central longitudinal axis, and said central longitudinal axis of each said bolt means being disposed at about 3.5 mm radially inward of the peripheral surface of said sheet transfer cylinder;

said bolt means have a diameter of about 8 mm;

said gripper means have a diameter of about 14 mm;

said finger means extend from said gripper means about 8 mm;

said sheet transfer cylinder has an axis of rotation;

said means for rotating said drive shaft means comprises:

cam means, said cam means having a cam surface disposed about the axis of rotation of said sheet transfer cylinder;

cam follower means for engaging said cam surface;

means connecting said drive shaft to said cam follower; and said cam surface, said cam follower means, and said connecting means being configured to reciprocally rotate said drive shaft means between said third and said fourth position upon rotation of said sheet transfer cylinder.

3. A sheet transfer cylinder for conveying sheets of printing stock for a rotary printing press, said sheet transfer cylinder comprising:

a plurality of gripper means disposed along the length of said sheet transfer cylinder, each of said gripper means comprising means for engaging an edge of a sheet being conveyed to move the engaged sheet upon rotation of said sheet transfer cylinder;

means for individually pivotably mounting each of said plurality of gripper means to said cylinder separately from others of said gripper means for pivotable movement of each of said gripper means independently from pivotable movement of others of said gripper means;

drive shaft means disposed spaced apart from said gripper means, said drive shaft means for driving each said gripper means to pivot each said gripper means and engage and disengage each said means for engaging with sheets being transferred, said drive shaft means comprising a periphery, the periphery comprising first and second portions;

said first portion of said periphery comprising a portion defining at least a first radius;

said second portion of said periphery of said drive shaft means comprising projections extending a substantial distance away from said first portion of said periphery of said drive shaft means to each of said plurality of gripper means to pivot each said gripper means separately from others of said gripper means upon movement of said drive means;

said projections defining a second radius substantially greater than said first radius;

said first portion of said periphery comprising a substantial portion of the periphery of said drive shaft means;

said sheet transfer cylinder comprises a longitudinal recess;

said drive shaft means being disposed within said longitudinal recess;

said projections extending from said drive shaft means comprises a plurality of individual drive means extending from said drive shaft means to individual ones of said gripper means;

each of said plurality of individual drive means driving one of said plurality of gripper means upon movement of said drive shaft means;

each of said projections comprises about a 15° portion of the periphery of said shaft means;

each of said plurality of gripper means comprises a toothed portion extending therefrom;

each of said plurality of individual drive means comprising a toothed portion for engaging said toothed portions of each of said gripper means for movement of each of said gripper means along with movement of said drive shaft means;

said toothed portions of said individual drive means being pivotable through a first rotational angle upon rotation of said drive shaft means;

said toothed portions of said gripper means being pivoted through a second rotational angle during pivoting of said toothed portions of said individual drive means through said first rotational angle;

said second rotational angle is about three times greater than said first rotational angle;

said sheet transfer cylinder comprises a peripheral surface;

said longitudinal recess comprises a longitudinal groove in said sheet transfer cylinder;

said longitudinal groove comprises a peripheral area adjacent the peripheral surface of said sheet transfer cylinder;

each of said plurality of gripper means is individually pivotably mounted in said peripheral area of said longitudinal groove;

said means for engaging of each said gripper means comprises finger means extending from said gripper means;

said finger means being pivotable towards and away from said peripheral surface of said sheet transfer cylinder, between a first position and a second position, to clamp a sheet of printing stock therebetween;

each said finger means comprises a contact surface for contacting a sheet of printing stock;

said contact surface having a longitudinal dimension;

said contact surface being convexly curved in the longitudinal dimension thereof;

said toothed portion of said individual drive means define a first circumference and said toothed portion of said plurality of gripper means define a second circumference, and a ratio of said first circumference to said second circumference defines a reduction ratio of about 3:1 for providing said second rotational angle about three times greater than said first rotational angle;

said contact surface has a radius of curvature of about 12 mm;

said means for mounting comprises bolt means, and each said gripper means is individually mounted in said groove by a corresponding individual bolt means;

said bolt means having a central longitudinal axis, and said central longitudinal axis of each said bolt means being disposed at about 3.5 mm radially inward of the peripheral surface of said sheet transfer cylinder;

said bolt means have a diameter of about 8 mm;

said gripper means have a diameter of about 14 mm;

said finger means extend from said gripper means about 8 mm;

said outer peripheral surface of said sheet transfer cylinder comprising an edge disposed adjacent said groove, and said outer peripheral surface of said sheet transfer cylinder comprising a pad disposed at said edge;

said pad comprising a friction pad;

said finger means being configured for clamping a sheet of printing stock between said contact surface thereof and said pad of said peripheral surface;

said sheet transfer cylinder has an axis of rotation;

said means for rotating said drive shaft means comprises:

cam means, said cam means having a cam surface disposed about the axis of rotation of said sheet transfer cylinder;

cam follower means for engaging said cam surface;

means connecting said drive shaft to said cam follower; and said cam surface, said cam follower means, and said connecting means being configured to reciprocally rotate said drive shaft means through said first rotational angle between a third and a fourth position upon rotation of said sheet transfer cylinder;

said third and fourth positions being disposed at about a 15° angle with respect to one another; and said first and second positions being disposed at about 45° with respect to one another.

* * * * *